US010743659B2

(12) United States Patent
Fischer et al.

(10) Patent No.: US 10,743,659 B2
(45) Date of Patent: Aug. 18, 2020

(54) PULL-OUT GUIDE FOR A MOVABLE FURNITURE PART

(71) Applicant: Julius Blum GmbH, Hoechst (AT)

(72) Inventors: Florian Fischer, Hoechst (AT); Pascal Janser, Hoechst (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 16/657,476

(22) Filed: Oct. 18, 2019

(65) Prior Publication Data

US 2020/0046118 A1 Feb. 13, 2020

Related U.S. Application Data

(60) Division of application No. 15/397,246, filed on Jan. 3, 2017, now Pat. No. 10,485,342, which is a (Continued)

(30) Foreign Application Priority Data

Jul. 4, 2014 (AT) ..... 533/2014

(51) Int. Cl.
*A47B 88/463* (2017.01)
*A47B 88/467* (2017.01)
(Continued)

(52) U.S. Cl.
CPC ..... *A47B 88/463* (2017.01); *A47B 88/467* (2017.01); *E05D 15/0621* (2013.01);
(Continued)

(58) Field of Classification Search
CPC ..... A47B 88/463; A47B 88/467; E05F 1/02; E05D 15/0621
(Continued)

(56) References Cited

U.S. PATENT DOCUMENTS 3,876,263 A * 4/1975 Oleksiak ..... A47B 1/10 384/21
4,412,703 A * 11/1983 Simonson ..... A47B 88/483 384/21
(Continued)

FOREIGN PATENT DOCUMENTS

DE 20 2009 004 955 12/2010
EP 1 437 068 7/2004
(Continued)

OTHER PUBLICATIONS

International Search Report dated Sep. 16, 2015 in International (PCT) No. PCT/AT2015/000085.
(Continued)

*Primary Examiner* — James O Hansen
(74) *Attorney, Agent, or Firm* — Wenderoth, Lind & Ponack, L.L.P.

(57) ABSTRACT

The invention relates to a pull-out guide for a movable furniture part, including at least one rail horizontal in the installed position, and a drive element for a drive device for the movable furniture part, and the drive element can be fastened on the rail, in particular detachably fastened. The driver element can be brought from a release position in a fixing position with the rail by a fastening movement of the drive element, the fastening movement being carried out in the horizontal plane.

12 Claims, 19 Drawing Sheets

Related U.S. Application Data continuation of application No. PCT/AT2015/000085, filed on Jun. 8, 2015.

(51) Int. Cl.
*E05D 15/06* (2006.01)
*E05F 1/02* (2006.01)

(52) U.S. Cl.
CPC ..... *E05F 1/02* (2013.01); *A47B 2210/0091* (2013.01); *E05Y 2900/20* (2013.01)

(58) Field of Classification Search
USPC ..... 312/330.1, 334.1, 334.6, 334.8
See application file for complete search history.

(56) References Cited

U.S. PATENT DOCUMENTS

| | | | | |
|---|---|---|---|---|
| 5,584,550 | A * | 12/1996 | Kueng | A47B 88/483 312/334.6 |
| 6,979,065 | B2 * | 12/2005 | Egger | A47B 88/467 312/319.1 |
| 7,748,799 | B2 | 7/2010 | Kleinsasser | |
| 8,014,168 | B2 * | 9/2011 | Lanning | H01R 25/145 248/424 |
| 8,109,582 | B2 | 2/2012 | Dubach | |
| 8,256,853 | B2 * | 9/2012 | Chen | F16C 29/02 312/319.1 |
| 8,474,925 | B2 | 7/2013 | Koenig et al. | |
| 8,534,781 | B2 | 9/2013 | Netzer et al. | |
| 8,911,039 | B2 | 12/2014 | Radusin | |
| 9,295,329 | B2 | 3/2016 | Brunnmayr et al. | |
| 2010/0123378 | A1 | 5/2010 | Chen et al. | |
| 2010/0231107 | A1 | 9/2010 | Radusin | |
| 2010/0320888 | A1 | 12/2010 | Koenig et al. | |
| 2011/0115353 | A1 | 5/2011 | Domenig et al. | |
| 2012/0038255 | A1 | 2/2012 | Netzer et al. | |
| 2013/0076218 | A1 | 3/2013 | Radusin | |
| 2013/0140970 | A1 | 6/2013 | Dubach | |
| 2013/0334946 | A1 | 12/2013 | Netzer et al. | |
| 2014/0021840 | A1 | 1/2014 | Radusin | |
| 2014/0210329 | A1 | 7/2014 | Brunnmayr | |
| 2015/0097473 | A1 | 4/2015 | Brunnmayr et al. | |
| 2017/0079430 | A1 | 3/2017 | Goetz | |

FOREIGN PATENT DOCUMENTS

| | | |
|---|---|---|
| EP | 2 168 454 | 3/2010 |
| JP | 56-91686 | 7/1981 |
| JP | 2011-515129 | 5/2011 |
| TW | M453420 | 5/2013 |
| TW | M469811 | 1/2014 |
| TW | M472452 | 2/2014 |
| WO | 2009/047139 | 4/2009 |
| WO | 2010/129971 | 11/2010 |
| WO | 2012/156229 | 11/2012 |
| WO | 2013/059847 | 5/2013 |
| WO | 2014/008519 | 1/2014 |
| WO | 2014/032063 | 3/2014 |

OTHER PUBLICATIONS

Search Report dated May 8, 2015 in Austrian Application No. 533/2014, with English translation.

* cited by examiner

L

M

M

F

F

F

F

L

3
B
9
10
4

PULL-OUT GUIDE FOR A MOVABLE FURNITURE PART

BACKGROUND OF THE INVENTION

The invention concerns an extension guide for a movable furniture part, comprising at least one rail which is oriented horizontally in the mounting position and an entrainment member for a drive device for the movable furniture part. The entrainment member can be detachably fastened on the rail, and the entrainment member can be brought from a release position in a fixing position with the rail by way of a fastening movement of the entrainment member. Moreover, the invention concerns an arrangement comprising such an extension guide, and a drive device for the movable furniture part. The invention further concerns an item of furniture comprising the previously-mentioned extension guide and the previously-mentioned arrangement respectively. Furthermore, the invention concerns a method for fastening an entrainment member on a rail of an extension guide for a movable furniture part, in which the entrainment member is brought from a release position in a fixing position with the rail by way of a fastening movement.

In the industrial sector of furniture fittings, miscellaneous mechanic devices for moving a movable furniture part, as for example a drawer or a flap, have already been known for many years. Especially with drawers, so-called ejection devices are known with which an unlocking of the ejection device is effected by pressing on the movable furniture part situated in the closing position, whereupon the movable furniture part is ejected in opening direction. In a reverse manner, however, retracting devices are also known by which the movable furniture part is automatically retracted into a closing position, in particular in the last closing section. Examples of various kinds of drive devices for movable furniture part are disclosed in WO 2014/008519 A1 or in WO 2010/129971 A1.

Now, such drive devices mostly have in common that a movement transmission between the movable furniture part and the furniture carcass has to be carried out somewhere. Especially if such drive devices are applied with a drawer, these drive devices are arranged in the area of the extension guide. Mostly, the drive device is assembled in a housing, wherein a movable component of this drive device can be coupled with an entrainment member for the execution of the opening of closing movement. This entrainment member can be arranged, e.g., on a carcass rail or on a drawer rail.

Now it is already known to not a priori build such entrainment members in a fixed connection with the respective rail, but to detachably fasten this entrainment member on the respective rail. For this purpose the entrainment member is brought from a release position in a fixing position with the rail by a fastening movement of the entrainment member. An example for such a catch-connectable activator or entrainment member is disclosed in WO 2009/047139 A1. This activator or entrainment member can here be coupled with a self-retracting device and a retracting device respectively and is not a part of an ejection device.

A problem with such entrainment members which can be retrofitted especially occurs when the extension guide is already mounted to the furniture carcass. In that case, it is actually difficult with the entrainment member to reach the areas designated for retrofitting. Therefore, it is often the case that an extension guide has to be removed, subsequently the entrainment member has to be fastened accordingly, and then the extension guide has to be mounted again to the furniture carcass.

SUMMARY OF THE INVENTION

The object of the present invention therefore is to establish an improved extension guide compared to the prior art. In particular, a retrofitting of the entrainment member should be carried out in an uncomplicated, simple, easily-reachable manner, and with little space requirement.

This object is attained by an extension guide according to the invention, in which the fastening movement is carried out in a horizontal plane. As there is little space available especially for movements in height direction in the case of an already mounted extension guide, an uncomplicated and fast mounting is also guaranteed by this fastening movement in a horizontal plane in the case of an already attached extension guide. Thus, the fastening movement generally enables that the entrainment member can also be fastened, preferably detachably fastened, to the rail in the case when the extension guide is pre-mounted to the furniture carcass.

Basically, it is possible that at least a short section of the fastening movement also comprises a vertical component. For example, the fastening movement can also partly be carried out in a space above the horizontal plane—in which substantial movement sections of the fastening movement take place or which is located in a plane adjacent to the underside of the rail. Preferably, if the fastening movement also comprises at least a vertical movement section, this vertical fastening movement component can be carried out only above the horizontal plane. The fastening movement generally starts with the first contact of the entrainment member with the rail when fastening.

Particularly preferred, however, the fastening movement is carried out only in the horizontal plane. According to that, every further relative movement between the entrainment member and the rail only takes place in the horizontal plane starting from a first contact of the entrainment member with the rail. In this case, the large advantage is therein that as a result, the entrainment members on the lowest extension guides of an item of furniture can also be attached in a simple way. The lowest extension guides are mostly attached only a few millimeters above the floor of the furniture carcass. Thus, a retrofitting of an entrainment member is very difficult in this case, especially if larger movements in height direction ought to be carried out while retrofitting. With this present fastening and retrofitting possibility respectively of an entrainment member, now an entrainment member can be fastened in an easy manner also in the case of the lowest extension guides—where there is very little space—without a complex demounting of the extension guide.

In principle, the entrainment member only has to have the possibility to take one single fixing position on the rail. This fixing position can be irreversible. During the fastening movement, for example, clutches can extend which serve for a fixed and undetachable connection between the entrainment member and the rail. Preferably, however, the entrainment member in combination with the rail can be formed in such a way that the entrainment member is detachably fastened to the rail. Thus, by a release movement, the entrainment gets from the fixing position again in the release position.

For this kind of fastening movement, different variants are possible. This fixing position between the entrainment member and the rail can be reached, for example, by a translational relative movement, by a rotary movement, or by a mixed form of these movements. According to a preferred embodiment, the entrainment member is supported movably on the rail. In this case, a first embodiment provides that the entrainment member is supported pivotably about a vertical axis on the rail. Especially if a pivotable movement about a vertical axis is given, the fastening movement is guided or predefined in a simple way. A second embodiment provides that the fastening movement is carried out linearly. In this case, this fastening movement is guided by at least one guiding element. In this second variant for an easy reachability, it is particularly preferred that the fastening movement is carried out transverse to the longitudinal direction of the rail. For example, this fastening movement is carried out in an angle region between 45° and 135° to the longitudinal direction. Particularly preferred, the fastening movement is carried out in an angle of 90° to the longitudinal direction of the rail.

The entrainment member per se only has to be formed in such a way that a coupling with the drive device for the movable furniture part is possible. As quite large forces are transmitted in the area of the entrainment member, the entrainment member preferably comprises an entrainment bolt and a holding plate. In this case, the actual fixation of the entrainment member on the rail is carried out by the holding plate.

The connection of fixation between the entrainment member and the rail can be carried out by connecting parts. For this purpose, generally only one connecting part has to be present on the entrainment member, and one connecting counterpart has to be present on the rail, respectively. These connecting parts and connecting counterparts can be formed, e.g., in the form of screw connections or also by magnetic connections. Preferably, however, in the fixing position there is a friction-type and/or form-locking connection between the at least one connecting part and the at least one connecting counterpart.

According to a preferred embodiment, at least two, and preferably three, connecting parts are provided on the entrainment member, and at least two, and preferably three, connecting counterparts are provided on the rail.

In this case, preferably a first connecting part, preferably in the form of a pivot axis, is formed on the entrainment member, preferably on its holding plate, and a first connecting counterpart, preferably in the form keyhole-like recess, corresponding to the first connecting part is formed on the rail. The first connecting part in the form of a pivot axis can be inserted into this keyhole-like recess. Here, according to an embodiment, the first connecting part comprises a narrower, vertically oriented neck region, and a broader head region, and in the fixing position the first connecting part rests on the first connecting counterpart via the head region.

For the fixation of the entrainment member on the rail, preferably a second connecting part, preferably in the form of a lug which is bent L-shaped, is formed on the entrainment member, preferably on its holding plate, and a second connecting counterpart, preferably in the form of a recess, corresponding to the second connecting part is formed on the rail.

For a guided fasting movement, during the fastening movement, the second connecting part can be inserted, preferably by a swiveling movement in the horizontal plane, into the second connecting counterpart. This swiveling movement is preferably carried out about the first connecting part which is form as a pivot axis. For a good linkage, it is provided that in the fixing position, the second connecting part is in a friction-type connection, preferably by way of a jamming, with the second connection counterpart.

In addition, according to a preferred embodiment, a third connecting part, preferably in the form of a nub, is formed on the entrainment member, preferably on its holding plate, and a third connecting counterpart, preferably in the form of a recess or a punching, corresponding to the third connecting part, is formed on the rail. An elongated hole or a similar recess can be formed in the holding plate of the entrainment immediately in the vicinity of this nub, whereby a slightly elastic locking of the nub in the third connecting counterpart is enabled.

If the rail is formed from a bent sheet metal with a specific sheet metal thickness, and the entrainment member, preferably its holding plate, is attached to the underside of the rail in the fixing position, then—in order to optimize the space utilization of the extension guide in the item of furniture—preferably the entrainment member projects for maximal three, preferably for maximal one, sheet metal thicknesses in vertical direction from the underside of the rail. This means, the distance of the underside of the rail to the floor of the furniture carcass can, thus, be only very little and can only be three, two or even only one sheet metal thickness(es), and also with this little distance it is still guaranteed that an entrainment member can be retrofitted without the necessity of demounting the extension guide. This is also because of the reason that the entrainment member does not project more than three times, preferably never more than one time, the sheet metal thickness from the underside of the rail also during the whole fastening movement. In order to guarantee a stable linkage, preferably the holding plate abuts the underside of the rail in a zonally planar configuration.

As already mentioned, the entrainment member can also be retrofitted on the drawer rail or if applicable also on the center rail of an extension guide. Preferably, however, it is provided that the rail, with which the invention is described so far, is a carcass rail.

In an arrangement comprising an extension guide according to the invention and a drive device for the movable furniture part, the drive device can be, e.g., a retraction device. Preferably, this drive device is an ejection device, and the ejection device can be unlocked by over-pressing of a movable furniture part into an over-pressing position located behind a closed position. The movable furniture part is movable in an opening direction by an ejection force storage member. If the drive device is such an ejection device, preferably the entrainment member is an ejection entrainment member which can be contacted with the ejection device at least during a section of an ejection movement. Such an ejection device can be fastened to the movable furniture part, to the furniture carcass, or to a drawer rail of the extension guide.

An item of furniture comprises a furniture carcass, at least one movable furniture part, and at least one extension guide according to the invention for the movable furniture part.

The object of the present invention is also attained by a method in which the fastening movement is carried out in a horizontal plane. Particularly, this fastening movement is only carried out in this horizontal plane, hence only in a plane which is directly below the underside of the rail.

In order to guarantee an intuitive and secure fastening or fixation of the entrainment member on the rail, preferably during the fastening movement the entrainment is initially moved from the release position in a pre-mounting position, in which the entrainment member contacts the rail, and the entrainment member is subsequently moved from the pre-mounting position in the fixing position. Both movements of the entrainment member—from the release position in the pre-mounting position and from the pre-mounting position in the fixing position—are carried out in the same horizontal plane.

BRIEF DESCRIPTION OF THE DRAWINGS

Further details and advantages of the present invention are described more fully hereinafter by the specific description with reference to the embodiments illustrated in the drawings, in which.

DETAILED DESCRIPTION OF THE INVENTION

Figure 1:
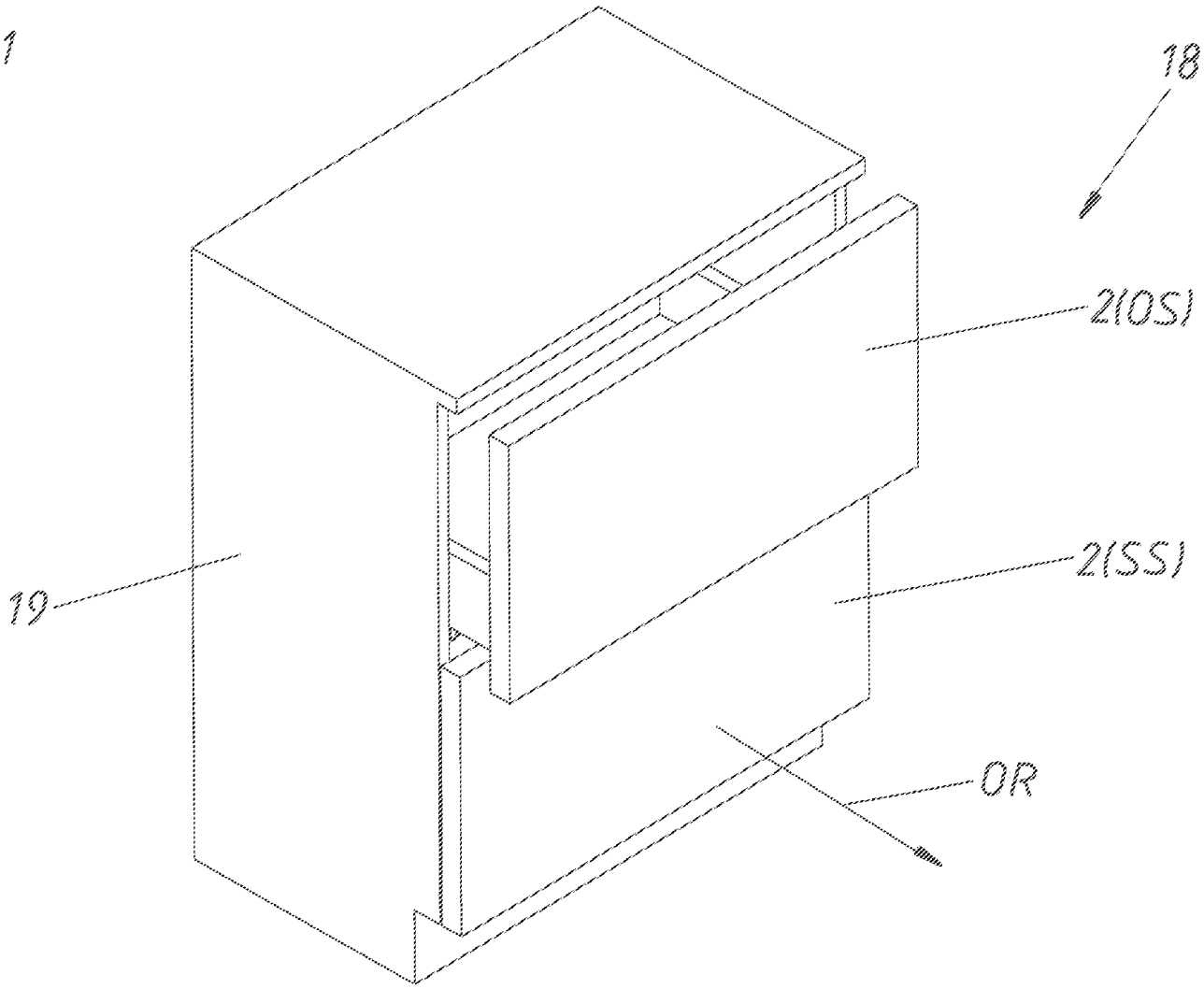
FIG. 1 is a perspective view of the item of furniture.

FIG. 1 shows an article of furniture 18 with a furniture carcass 19 and two movable furniture parts 2 in form of drawers arranged in the furniture carcass 19. The upper drawer is in an open position OS, whereas the lower drawer is in a closed position SS. By over-pressing the movable furniture part 2 in an over-pressing position located behind the closed position SS, an ejection device 15 (here not shown) is unlocked and the movable furniture part 2 is subsequently ejected into opening direction OR by an ejection force storage member. During this ejection movement the ejection device 15 (not shown) repels from an entrainment member 4 which is in a fixed relation to the furniture carcass 19. The drawers or movable furniture parts 2 are each movably supported on the furniture carcass 19 of the item of furniture 18 via extension guides 1.

Figure 2A:
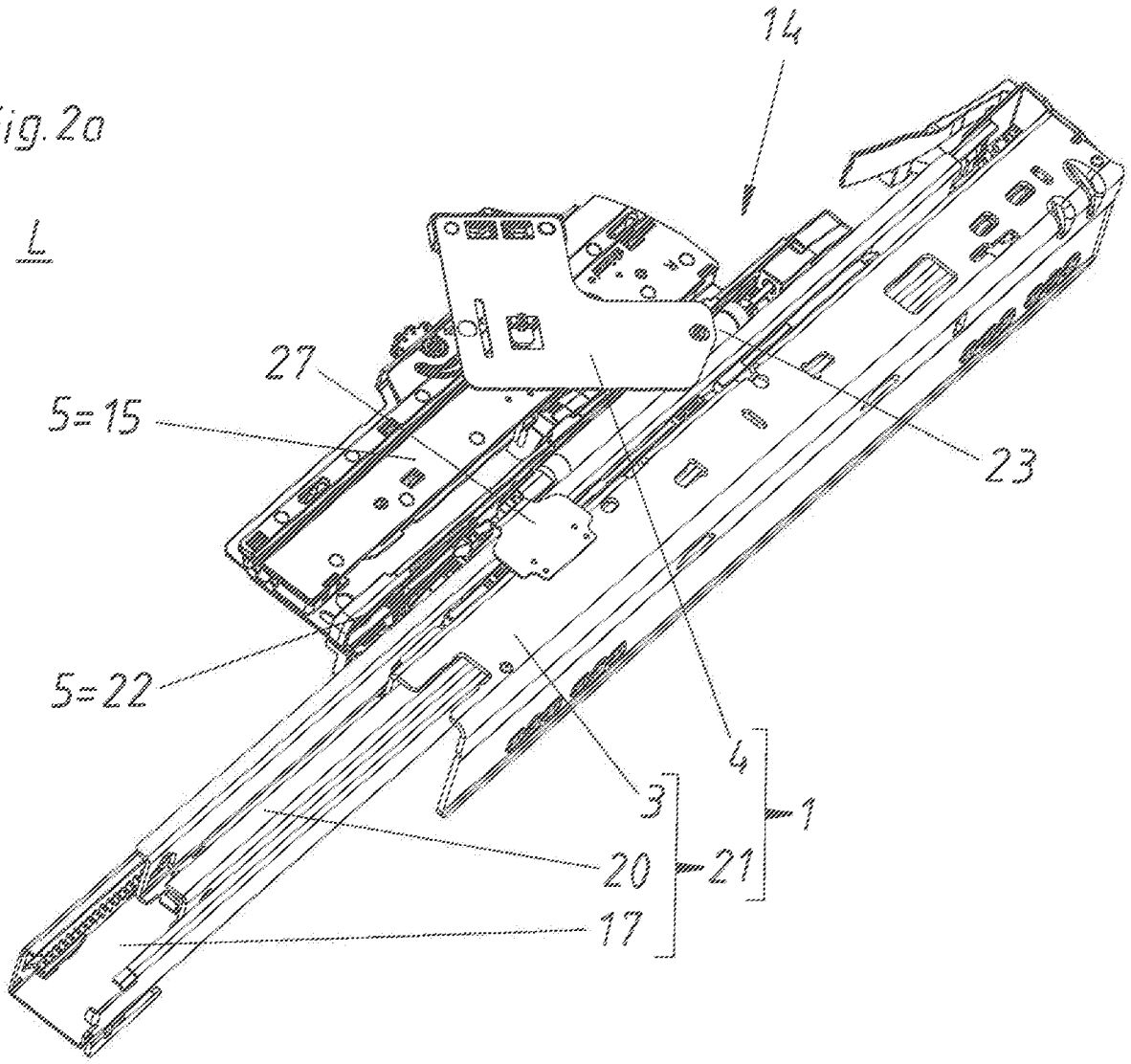
FIGS. 2*a* to 2*d* are different views of the entrainment member and the rail in the release position.

Corresponding thereto, FIG. 2 shows a (right) side of an extension guide 1 seen from the underside. The extension guide 1 comprises on the one hand a rail system 21 and on the other hand the entrainment member 4. The rail system 21 in turn comprises a rail 3 (carcass rail), if applicable a center rail 2 and a drawer rail 17. The drive device 5 in the form of a retraction device 22 is mounted to this drawer rail 17. The movable furniture part 2 can be retracted from an open position OS into the closed position SS via this retraction device 22. This retraction movement can be damped by a damping device 23. The retraction device 22 can be coupled via an entrainment member (retraction entrainment member 27), which in turn is mounted to the carcass rail 33. This retraction entrainment member 27 can also be formed in such a way that a fastening movement B according to the invention is possible. In this embodiment, however, it is already fixedly pre-mounted. The drive device 5 in the form of an ejection device 15 is fastened either directly to the drawer rail 17 or to an underside (not shown) of the movable furniture part 2. This ejection device 15 can be coupled to the rail 3, preferably the carcass rail, via the entrainment member 4, whereby the ejection device 15 together with the movable furniture part 2 can repel from the carcass-fixed entrainment member 4. The arrangement 14 is formed by at least one of these drive devices 5 together with the extension guide 1. According to this FIG. 2*a*, the entrainment member 4 is still in a release position L in which the entrainment member 4 does not yet contact the rail 3.

Figure 2B:
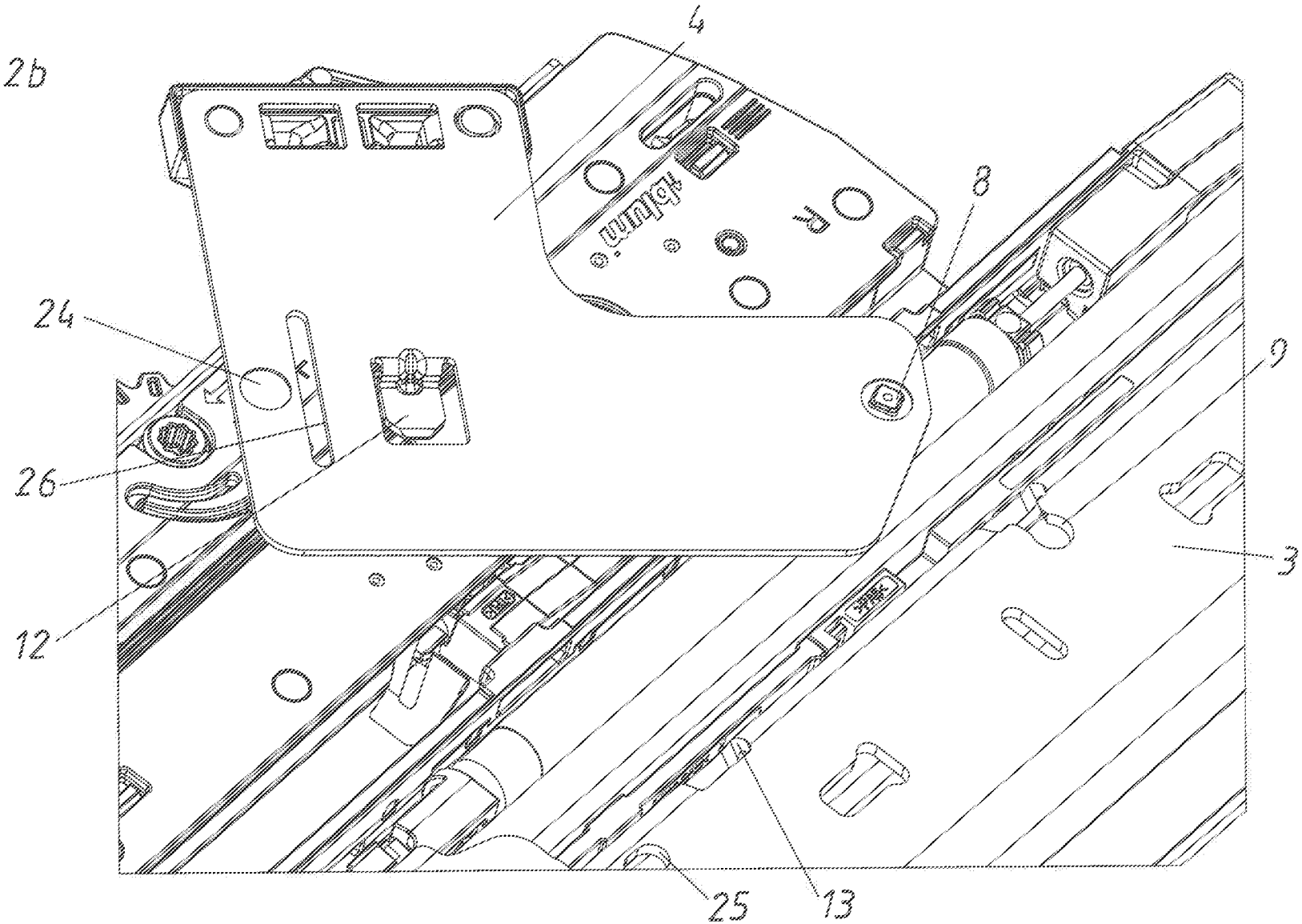

FIG. 2*b* shows a detail from FIG. 2*a*, in which it is recognizable that a first connecting part 8 in the form of a pivot axis is formed on the entrainment member 4 and on its holding plate 7 respectively, a second connecting part 12 is formed as a lug which is bent L-shaped, and a third connecting part 24 is formed as an elevation or a nub. Moreover, an elongated hole 26 is also formed in the holding plate 7 beside this third connecting part 24. Counterparts corresponding to these connecting parts 8, 12 and 24 are formed in the rail 3. For that, a first connecting counterpart 9 in the form of a keyhole-like recess is formed or punched out in the rail 3. Further, there is also a second connecting counterpart 13 for the second connecting part 12. Moreover, a third connecting counterpart 25 in the form of a punching out is also formed on the underside U of the rail 3.

Figures 2C, 2D:
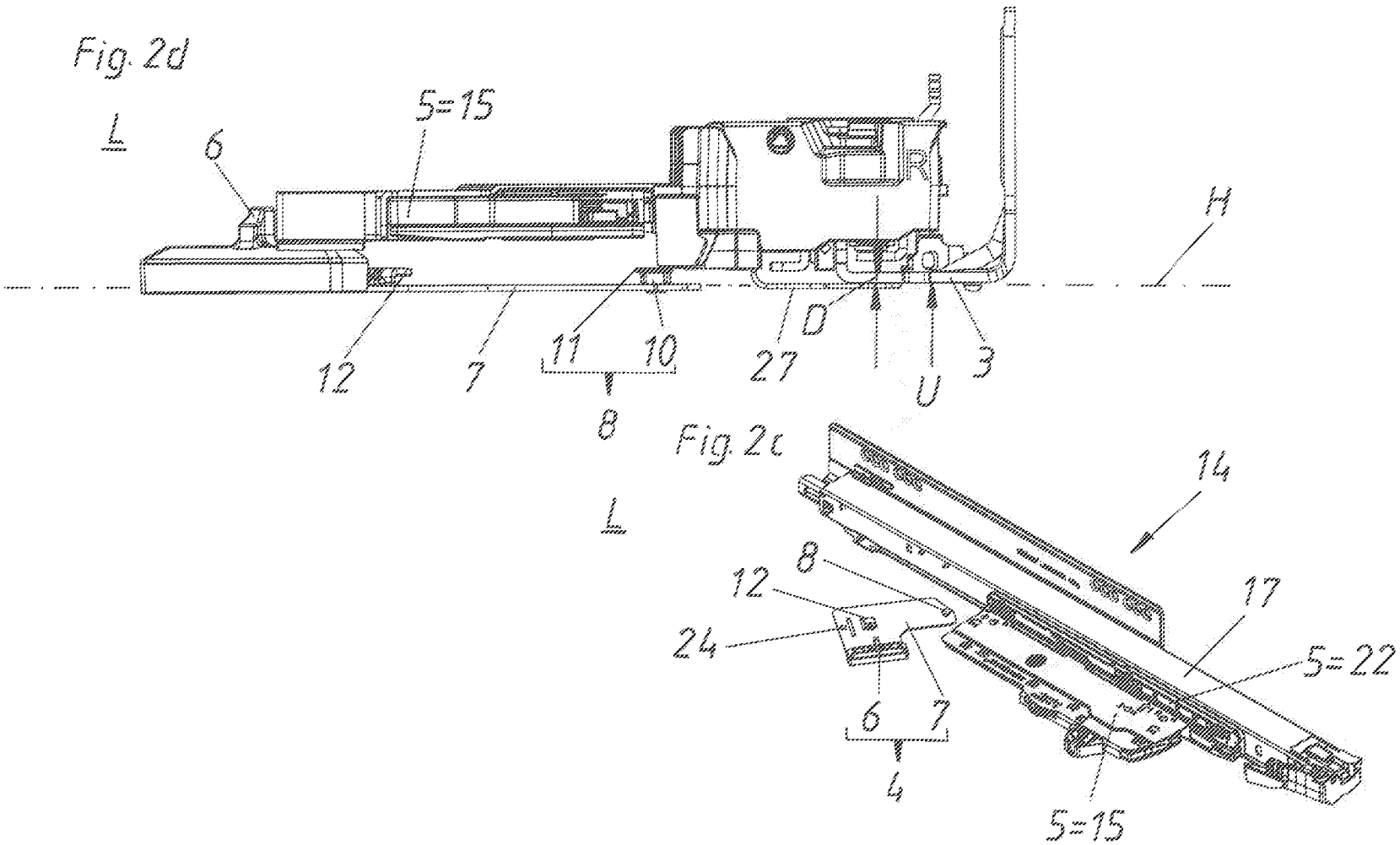
Figure 3A:
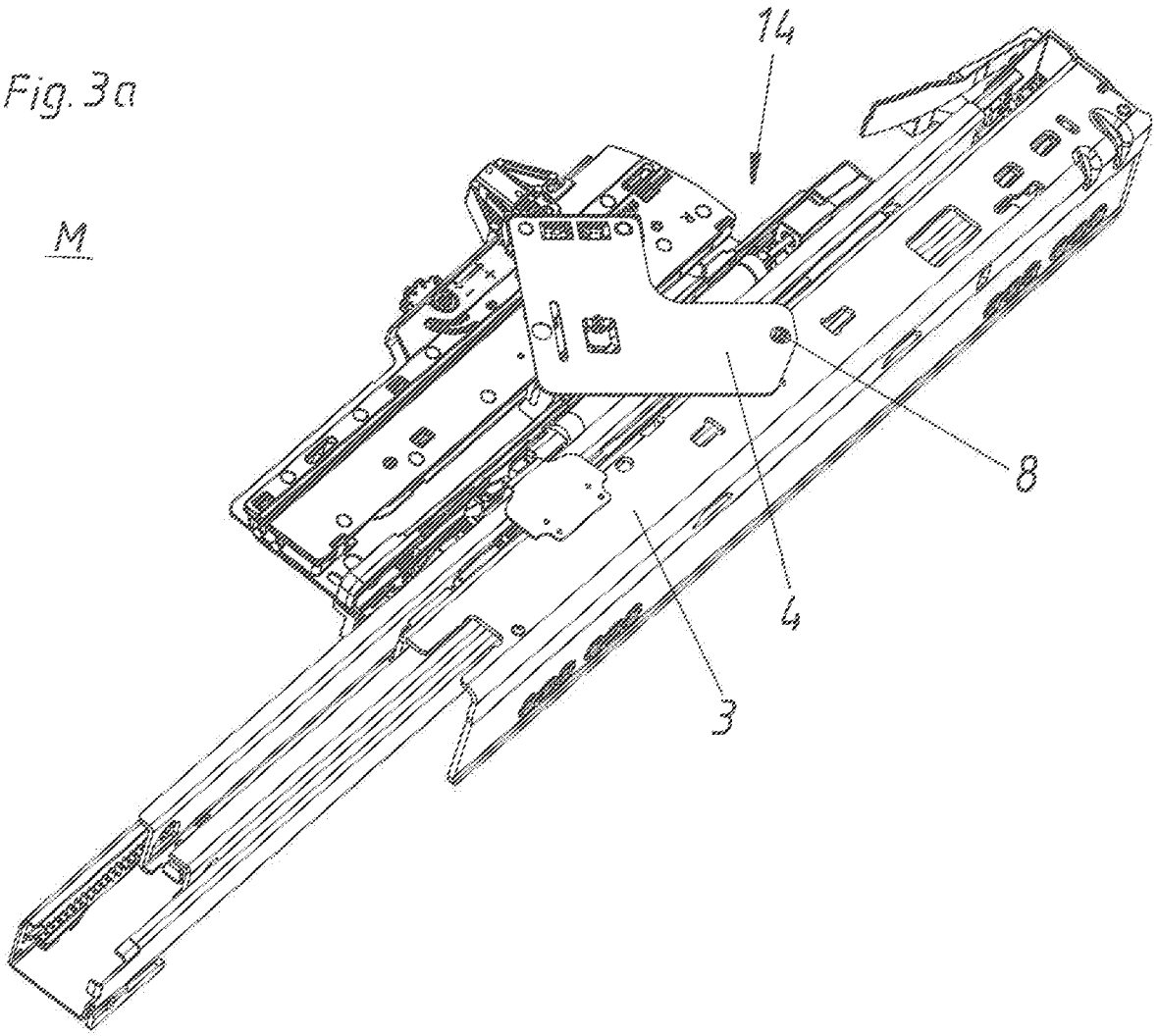
FIGS. 3*a* to 3*d* are different views of the entrainment member and the rail in the pre-mounting position.
Figure 3B:
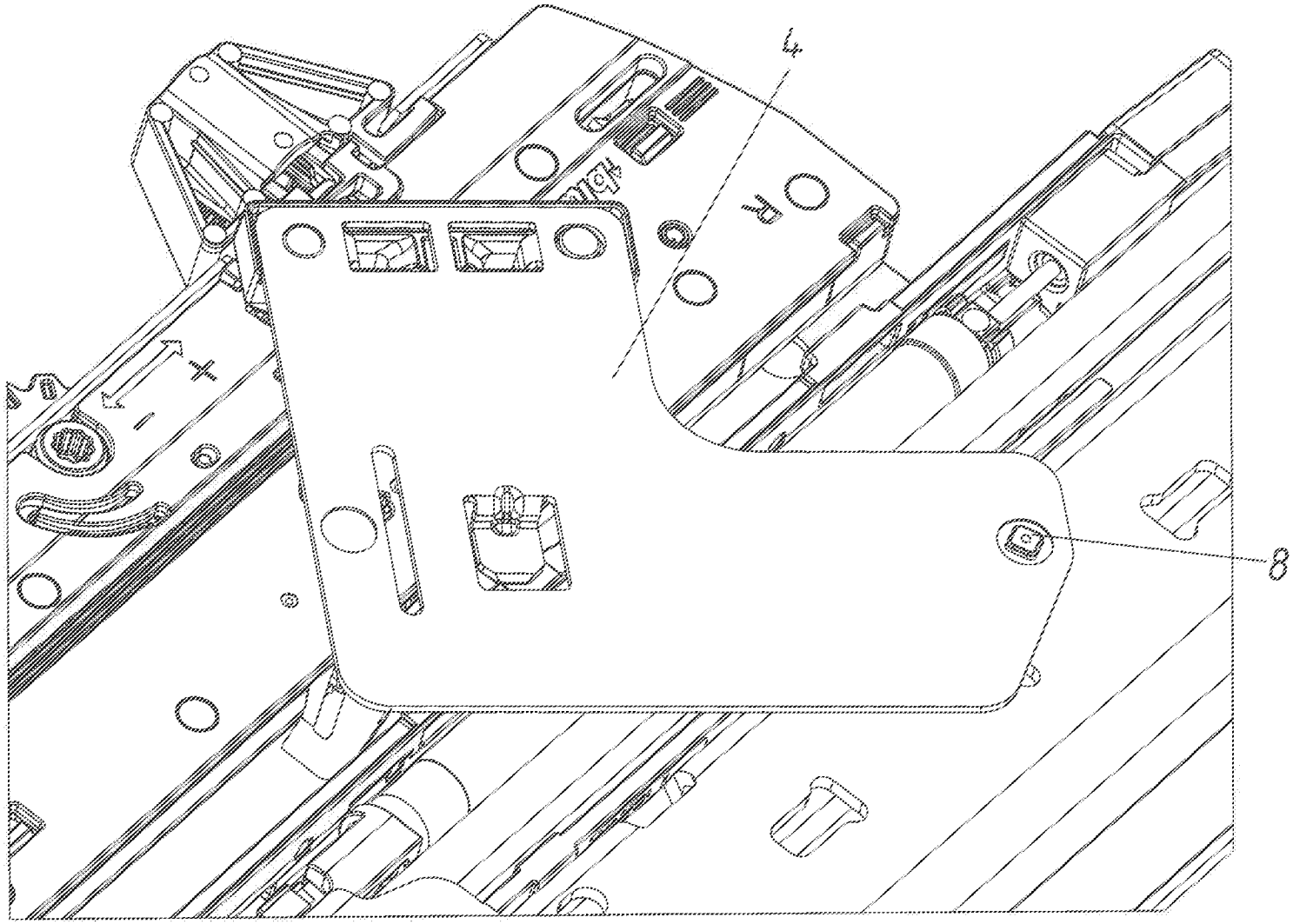
Figures 3C, 3D:
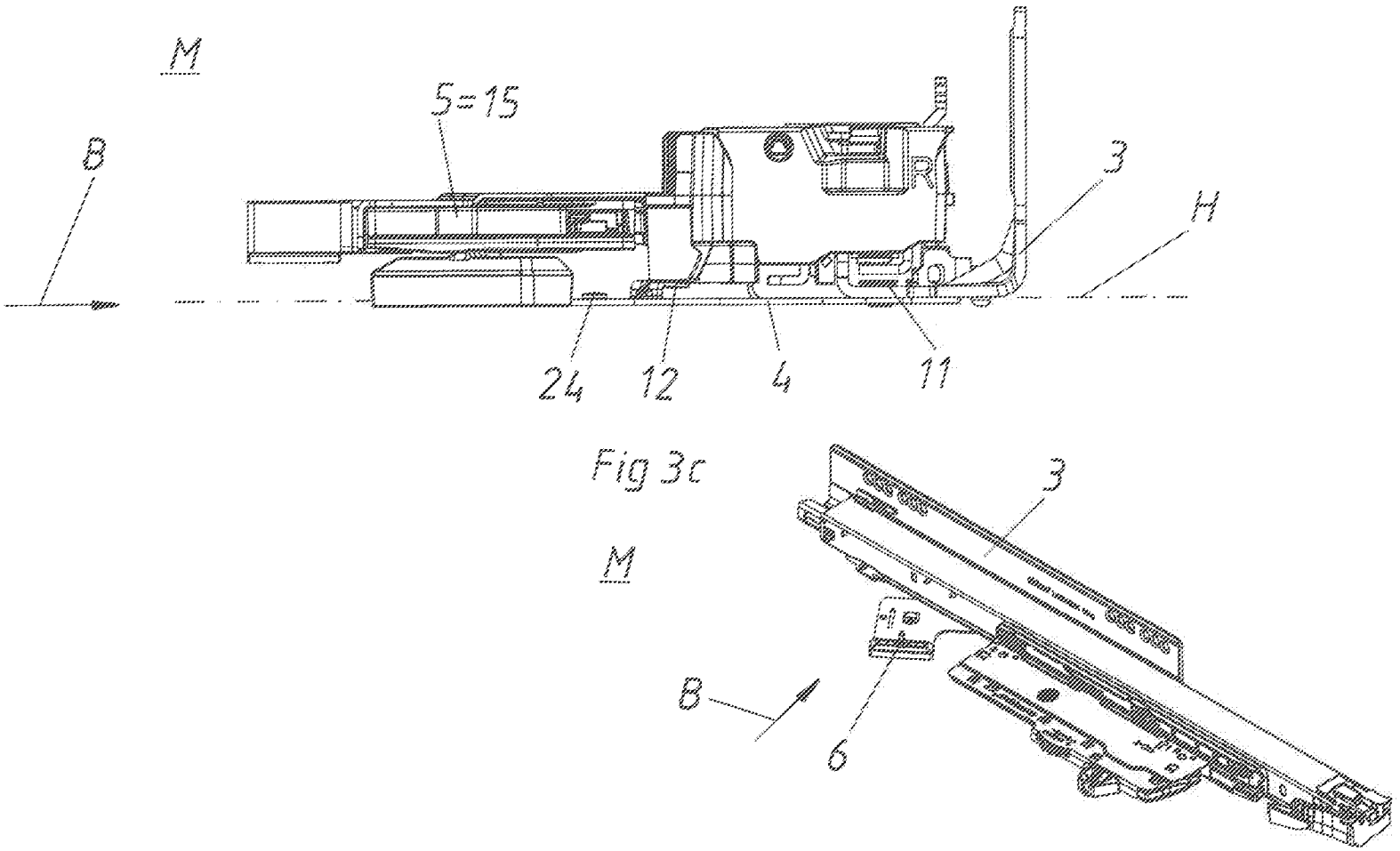

FIG. 2*c* shows the arrangement seen from above in an oblique angle. Also here, the entrainment member 4 is still in the release position L. The entrainment bolt 6 and the holding plate 7, which together form the entrainment member 4, are recognizable in this FIG. 2*c*. The connecting parts 8, 12 and 24 are arranged on this holding plate 7.

FIG. 2*d* shows a front view of the arrangement in a viewing direction against the opening direction OR. In this view according to FIG. 2*d*, the horizontal plane H—in which the fastening movement B takes place—is well recognizable. Also, here the entrainment member 4 is still in the release position L, in which there is still no contact between the entrainment member 4 and the rail 3. It is, however, recognizable that the second connecting part 12 comprises a slightly inclined or over-pressed lug, whereby subsequent during fastening, a pretensioning or jamming of the rail 3 between the holding plate 7 and this lug is possible. It is also recognizable that the first connecting part 8 comprises a narrower cylindrical neck portion 10 and a broader head portion 11. The transition between the neck portion 10 and the head portion 11 is provided with a slight rounding. Thereby, the entrainment member 4 can be retrofitted in the case of differently thick rails 3, wherein also in the case of these differently thick rails 3, a good connection without play is guaranteed. The sheet metal thickness D of the rail 3 is also illustrated in this FIG. 2*d*.

FIGS. 3*a* to 3*d* again correspond to the views shown in the FIGS. 2*a* to 2*d*, wherein the entrainment member 4 though is now in the pre-mounting position M. Especially in FIGS. 3*c* and 3*d*, it is apparent that the entrainment member 4 has already carried out a part of the fastening movement B which has begun with the contact between the entrainment member 4 and the rail 3. This first part of the fastening movement B is preferably carried out along a straight line. In this fastening movement B, the first connecting part 8 is inserted into the first connection counterpart 9. There, the neck portion 10 of the first connecting part 8 is just so narrow that this neck portion 10 fits through the narrow section of the keyhole-like recess (see especially FIG. 2*b*) till the neck portion 10 laterally abuts the edge of the recess which forms the connecting counterpart 9. As apparent in FIG. 3*d*, the head portion 11 now rests on the rail 3 and, thus, holds the entrainment member 4 already without jamming on the rail 3. Hence, the pre-mounting position M is reached.

Figure 4A:
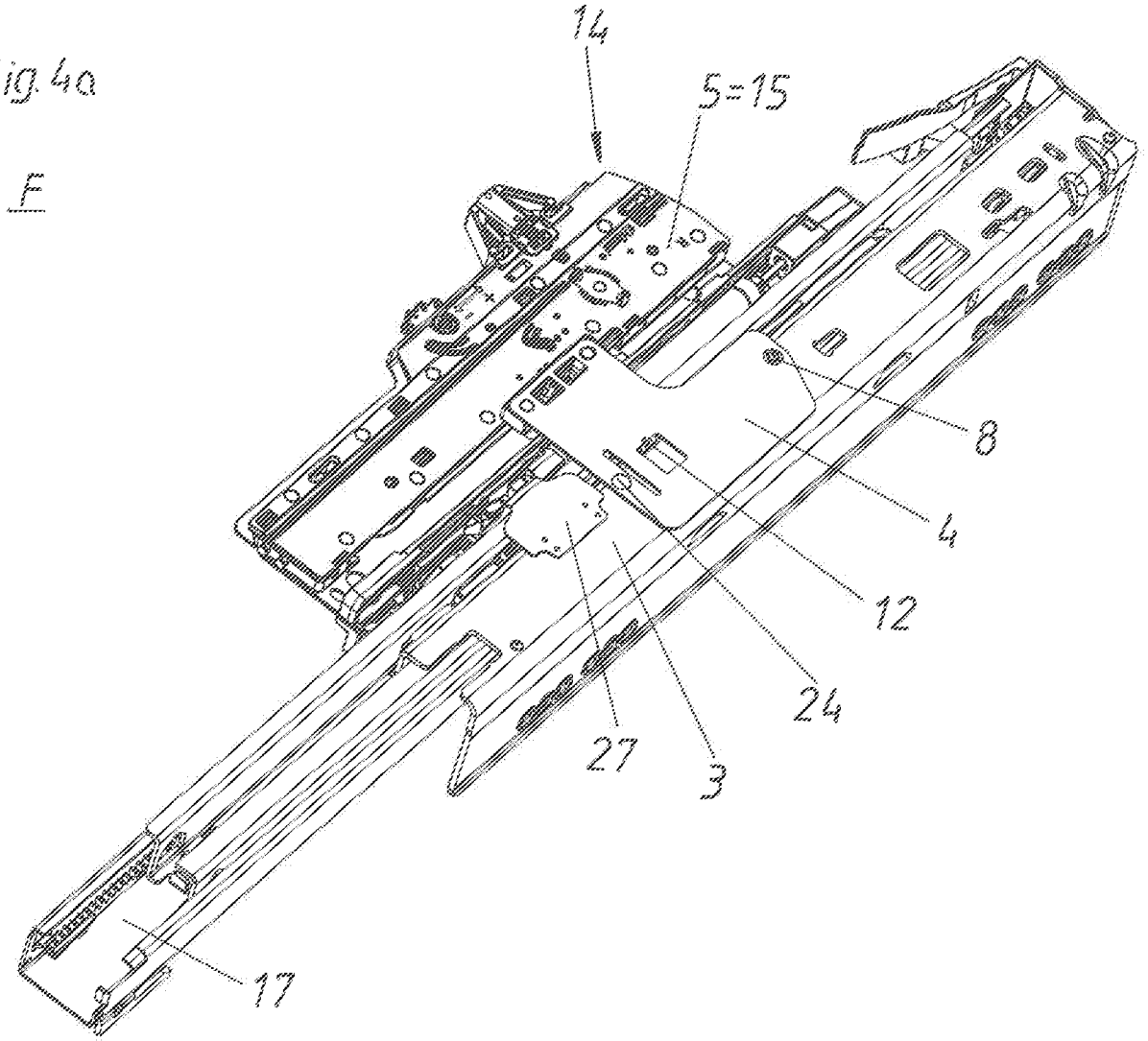
FIGS. 4*a* to 4*d* are different views of the entrainment member and the rail in the fixing position.
Figure 4B:
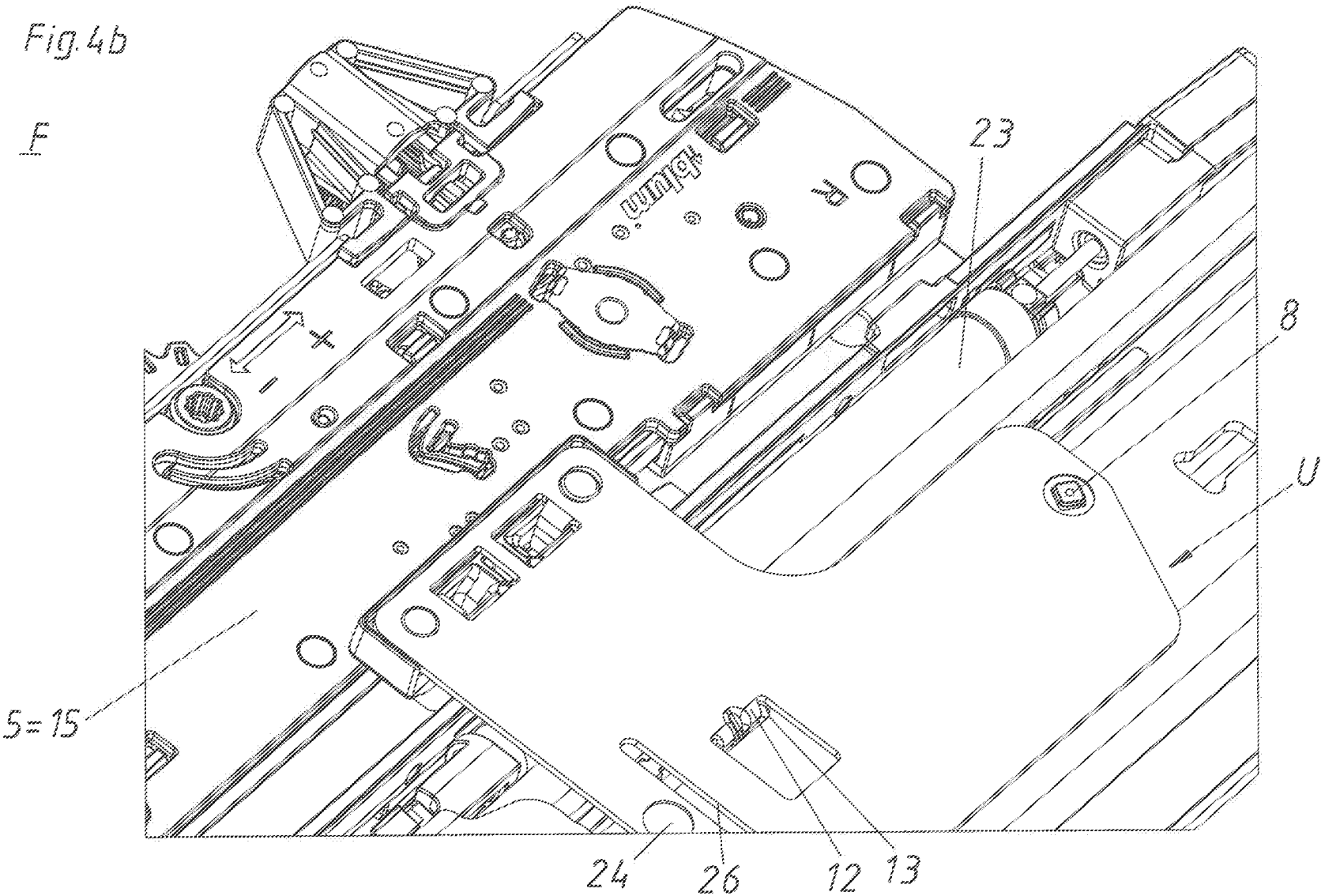
Figures 4C, 4D:
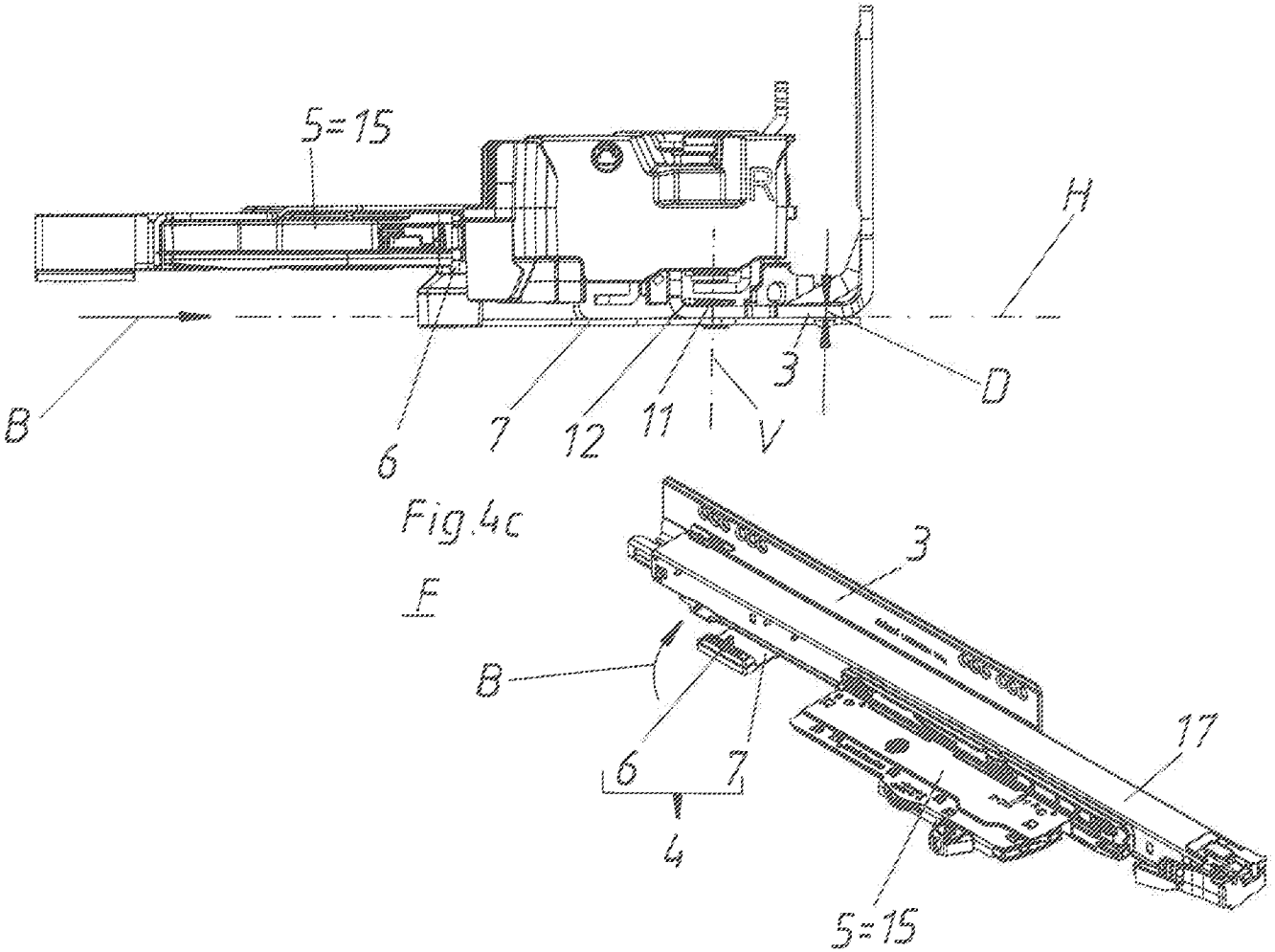

The FIGS. 4*a* to 4*d* again correspond to the views shown in the FIGS. 2*a* to 2*d*, wherein the entrainment member 4 is already in the fixing position F. For the fastening movement B, FIGS. 4*c* and 4*d* are especially referred to. This fastening movement B is effected as a swiveling movement about the pivot axis (vertical axis V) formed by the first connecting part 8. During this swiveling movement, on the one hand the second connecting part 12 reaches contact with the second connecting counterpart 13, and on the other hand the third connecting part 24 reaches contact with the third connecting counterpart 25. Also, this fastening movement B in turn is carried out—as recognizable well in FIG. 4*d*—only in the horizontal plane H. As also apparent in FIG. 4*d*, the entrainment member 4 does not project more than the sheet metal thickness D in the vertical direction from the underside U of the rail 3. This especially leads to the advantage that—if the rail 3 is attached in the lowest region of a furniture carcass 19—an easy retrofitting of the entrainment member 4 without movement in the height direction is possible.

With this fastening movement B from the pre-mounting position M in the fixing position F, a stable fixation of the entrainment member 4 on the rail 3 is carried out in three ways. An important component forms the second connecting part 12 which engages into the second connecting counterpart 13. By the pretensioning of the lug forming the second connecting part 12, a jamming of the rail 3 is effected between this lug and the holding plate 7. Thereby, a good friction-type connection between the entrainment member 4 and the rail 3 is already reached.

Moreover, the slightly convex nub—which forms the third connecting part 24—projects into the third connecting counterpart 25 formed by a recess or punching out in the rail 3. During insertion or drive over a slight bending or bulging of the holding plate 7 in the area of the third connecting part 24, an elongated hole 26 is formed in the holding plate 7. In this way, the area about the third connecting part 24 can be slightly bent during the fastening movement B by the contact with the rail 3, and can then again relax when reaching the third connecting counterpart 25, whereby a good connection is ensured.

Thirdly, a fixation and good connection is well reached in that the neck portion 10 of the first connecting part 8 comprises a rectangular cross section with rounded corners. By the rotation of this first connecting part 8 in the connecting counterpart 9, the connecting part 8—as long as it is in the position according to FIG. 4*b*—cannot be moved out anymore from the constriction of the connecting counterpart 9, because the neck portion 10 is broader in the area of the diagonal line than the narrowest spot of the first connecting counterpart 9.

Figure 5:
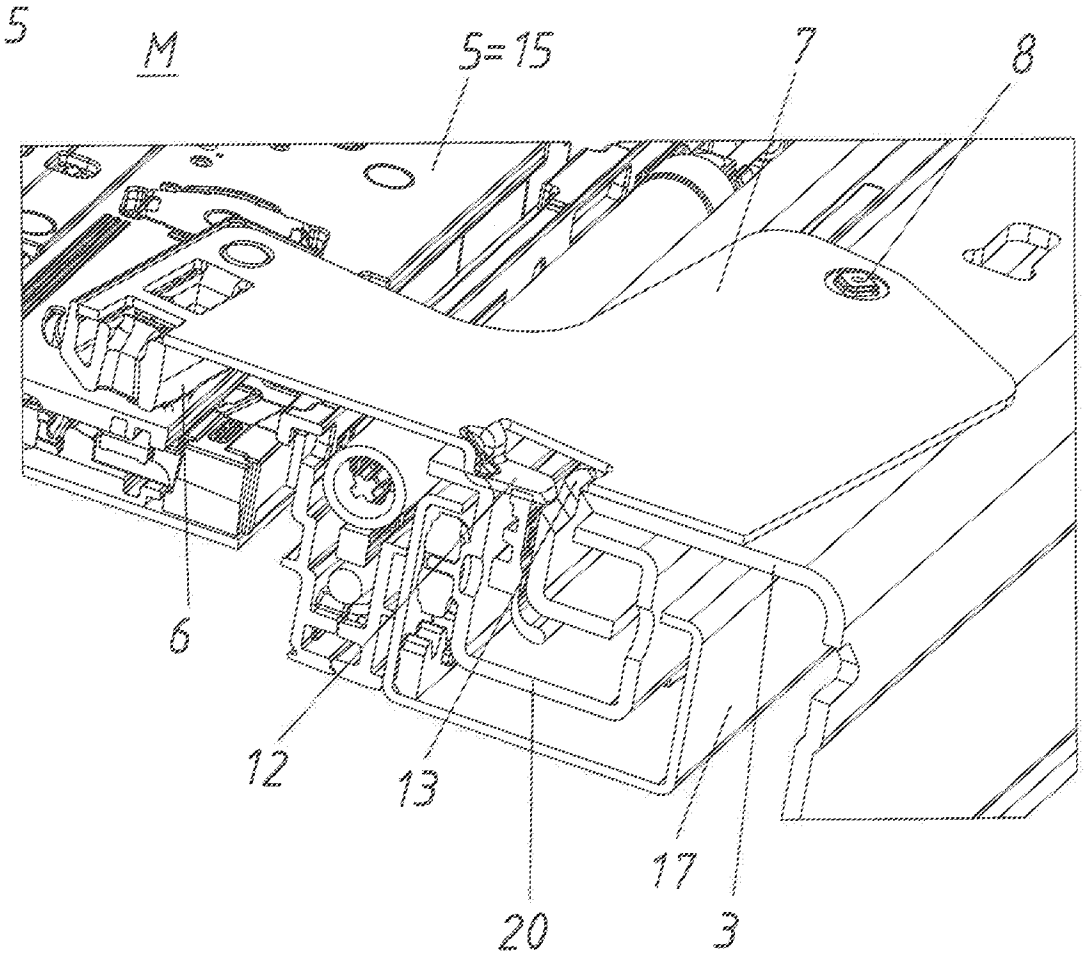
FIGS. 5 and 6 show sections through the rail and the entrainment member when swiveling in the fixing position.
Figure 6:
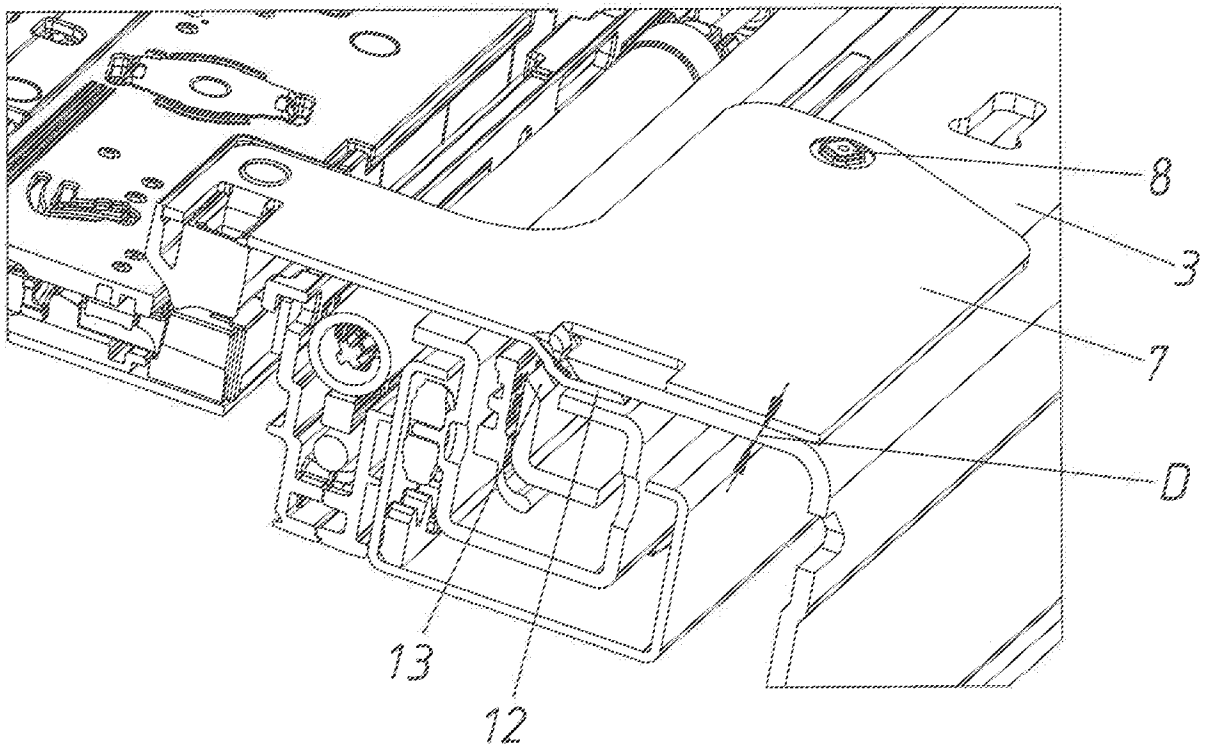

In the comparison between the FIGS. 5 and 6, the fastening movement B between the pre-mounting position M and the fixing position F is again clarified. In this case, the lug forming the second connecting part 12 engages in the rail 3 through the second connecting counterpart 13, whereby a jamming of the rail 3 between the lug and the holding plate 7 is effected (see especially FIG. 6).

Figure 7B:
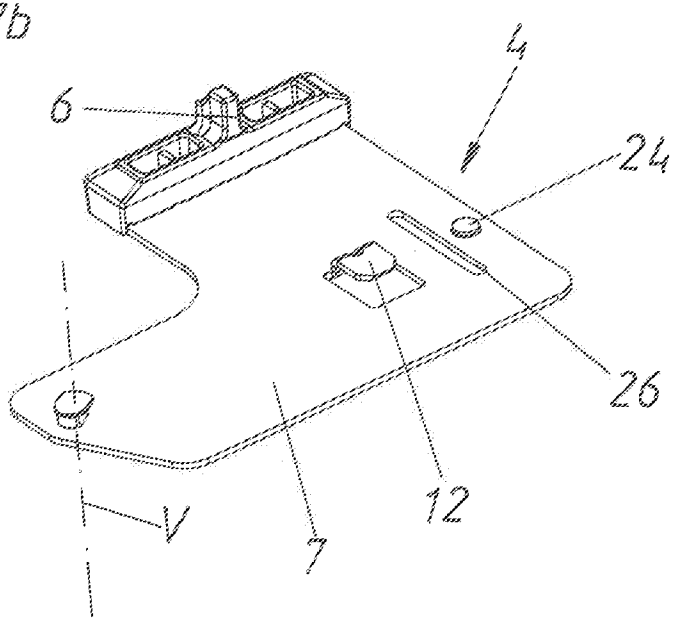
FIGS. 7*a* and 7*b* are different perspective views of the entrainment member.
Figure 7A:
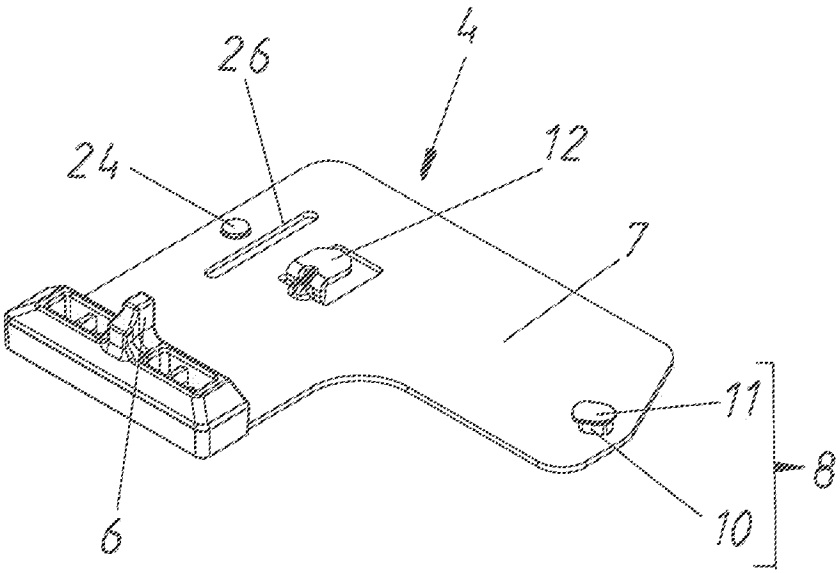

FIGS. 7*a* and 7*b* again clarify the connecting parts 8, 12 and 24 of the entrainment member 4. There, the first connecting part 8 forms a vertical axis V for the swiveling movement of the entrainment member 4. It is also apparent that the neck portion 10 of the first connecting part 8 is not circular cylindrical, but instead in the form of a cylinder with a substantially quadrangular base area. The holding plate 7 of the entrainment member 4 is preferably built of metal, whereas the entrainment bolt 6 is formed of plastic material. The first connecting part 8 can be welded onto the holding plate 7. In contrast, the second connecting part 12 and the third connecting part 24 can be bent out or punched out of the holding plate 7. The same applies for the elongated hole 26.

Figure 8:
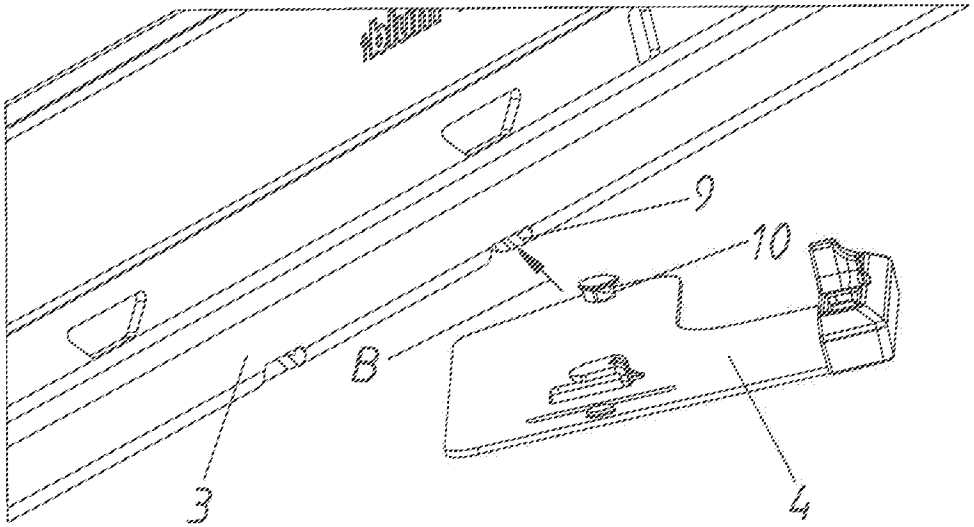
FIGS. 8 to 10 show the fastening movement of the entrainment member on the rail.

FIG. 8 again shows the fastening movement B along a straight line when inserting the entrainment member 4 into the rail 3. There, the neck portion 10 in this position of the entrainment member 4 exactly fits through the constriction of the first connecting counterpart 9.

Figure 9:
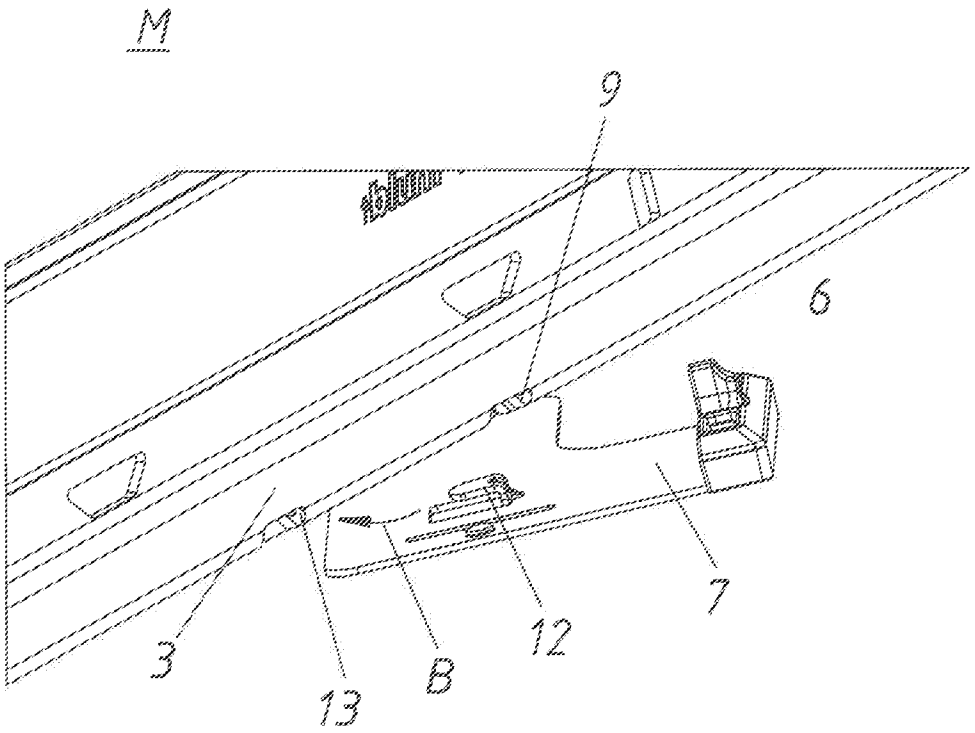

As soon as this insertion is complete, the pre-mounting position M according to FIG. 9 is reached. Then, the second part of the fastening movement B in the horizontal plane H is carried out by a fastening movement B in the form of a swiveling movement about the vertical axis V formed by the first connecting part 8.

Figure 10F:
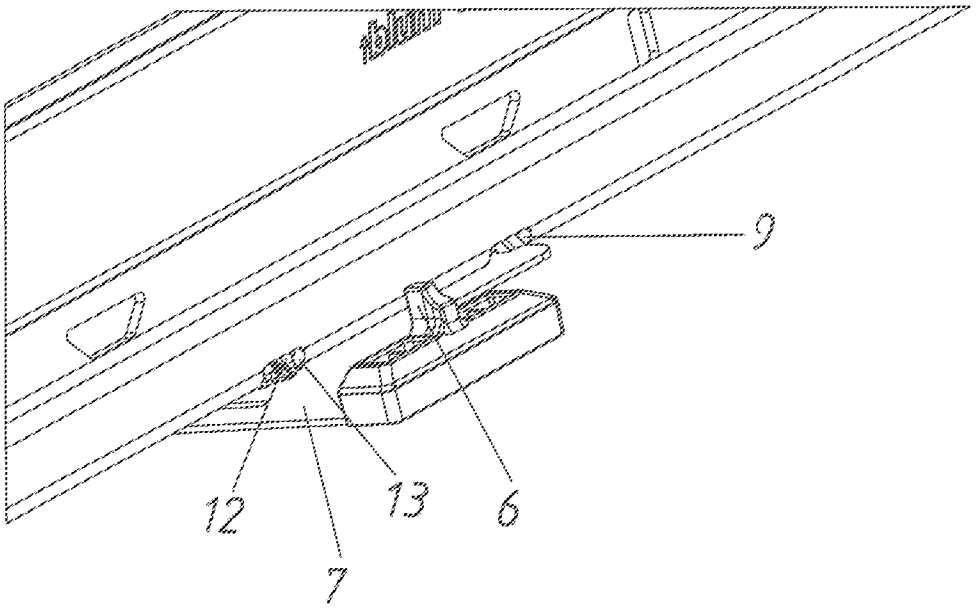

Towards the end of the swiveling movement, the second connecting part 12 reaches a friction-type connection with the second connecting counterpart 13, and also the third connecting part 24 reaches a friction-type connection with the third connecting counterpart 25, whereby the fixing position F according to FIG. 10 is reached.

With respect to the first embodiment, it shall conclusively be mentioned that—besides the first connecting part 8—also only the second connecting counterpart 12 or only the third connecting part 24 can be provided. Further, it shall be mentioned that in the first embodiment, the fastening movement B is always carried out only along the horizontal plane H. However, a part of the fastening movement B can certainly comprise a vertical fastening movement component which is carried out above the horizontal plane H. So it could certainly be the case that the first connecting part 8 is mounted "from above"—thus vertically—in or on the first connecting counterpart 9 during the fastening movement B from the release position L in the pre-mounting position M. Afterwards, the fastening movement B from the pre-mounting position M in the fixing position F is again carried out only in the horizontal plane H.

The illustrations shown so far describe a preferred embodiment of the present invention. In contrast to this preferred embodiment, however, another kind of fastening movement B in a horizontal plane H can be carried out. This fastening movement B is illustrated in the FIGS. 11 to 13.

Figure 11:
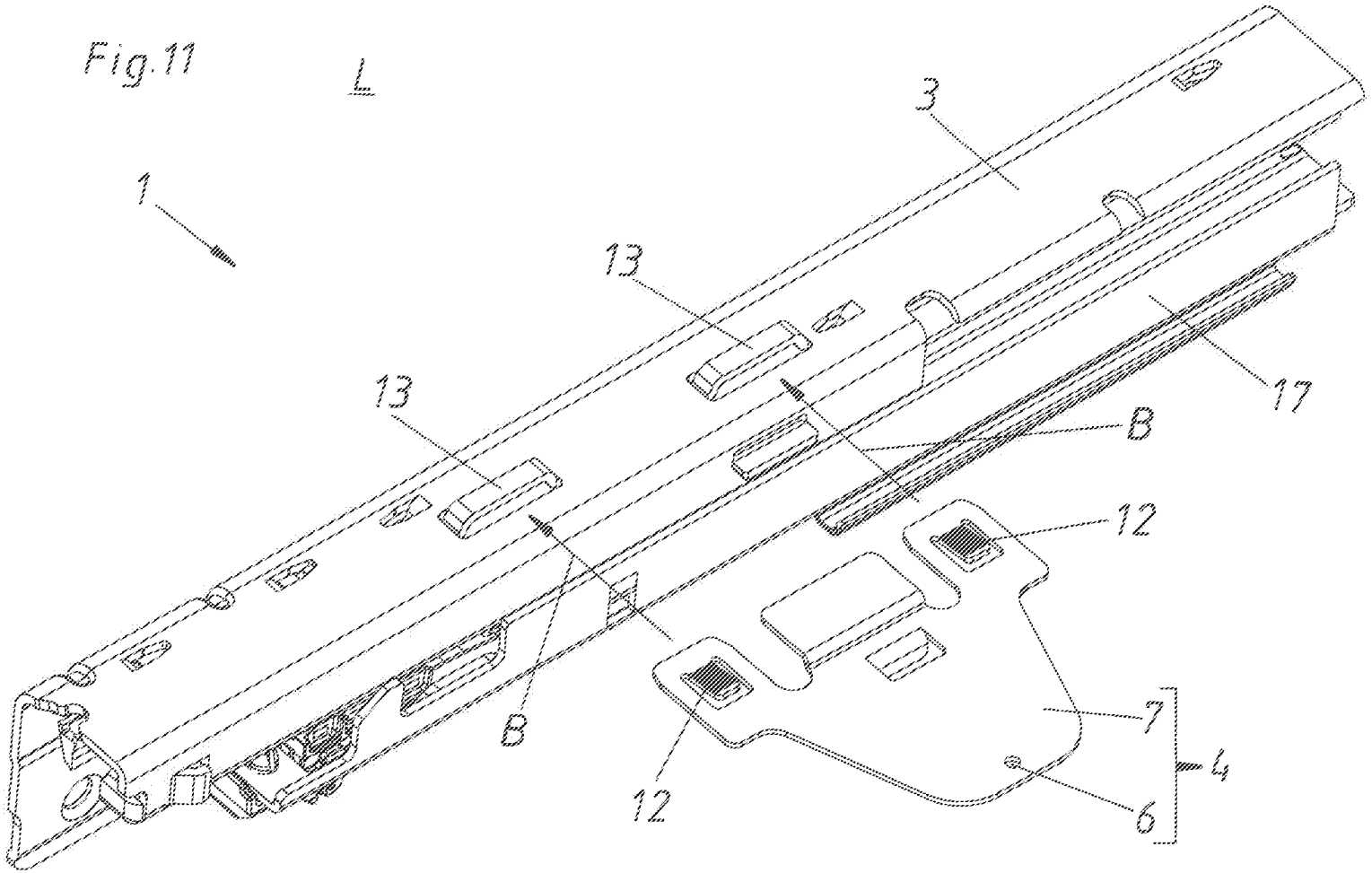
FIGS. 11 to 13 show an alternative embodiment of a fastening movement of an entrainment member on the rail.
Figure 12F:
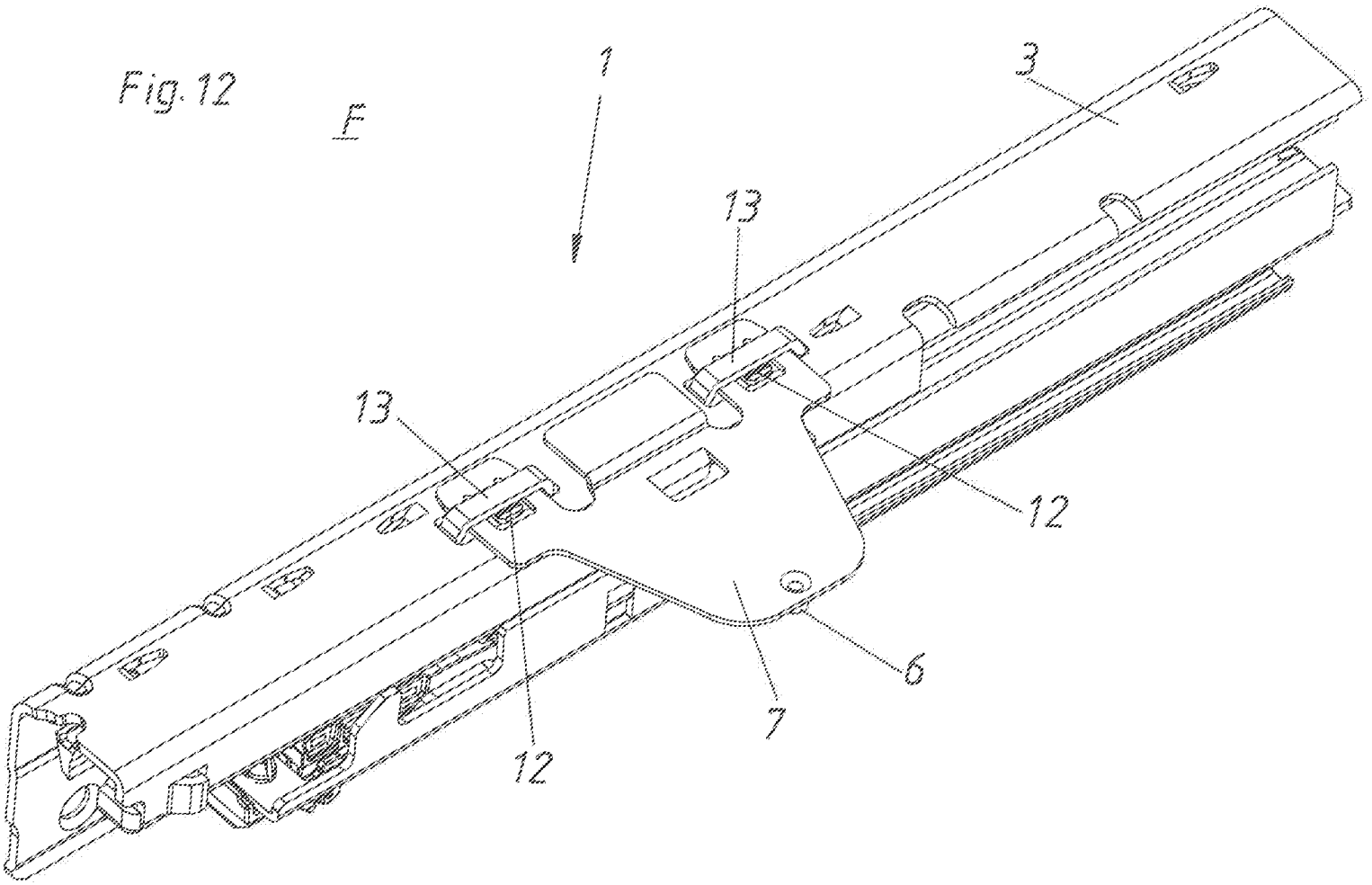
Figure 13:
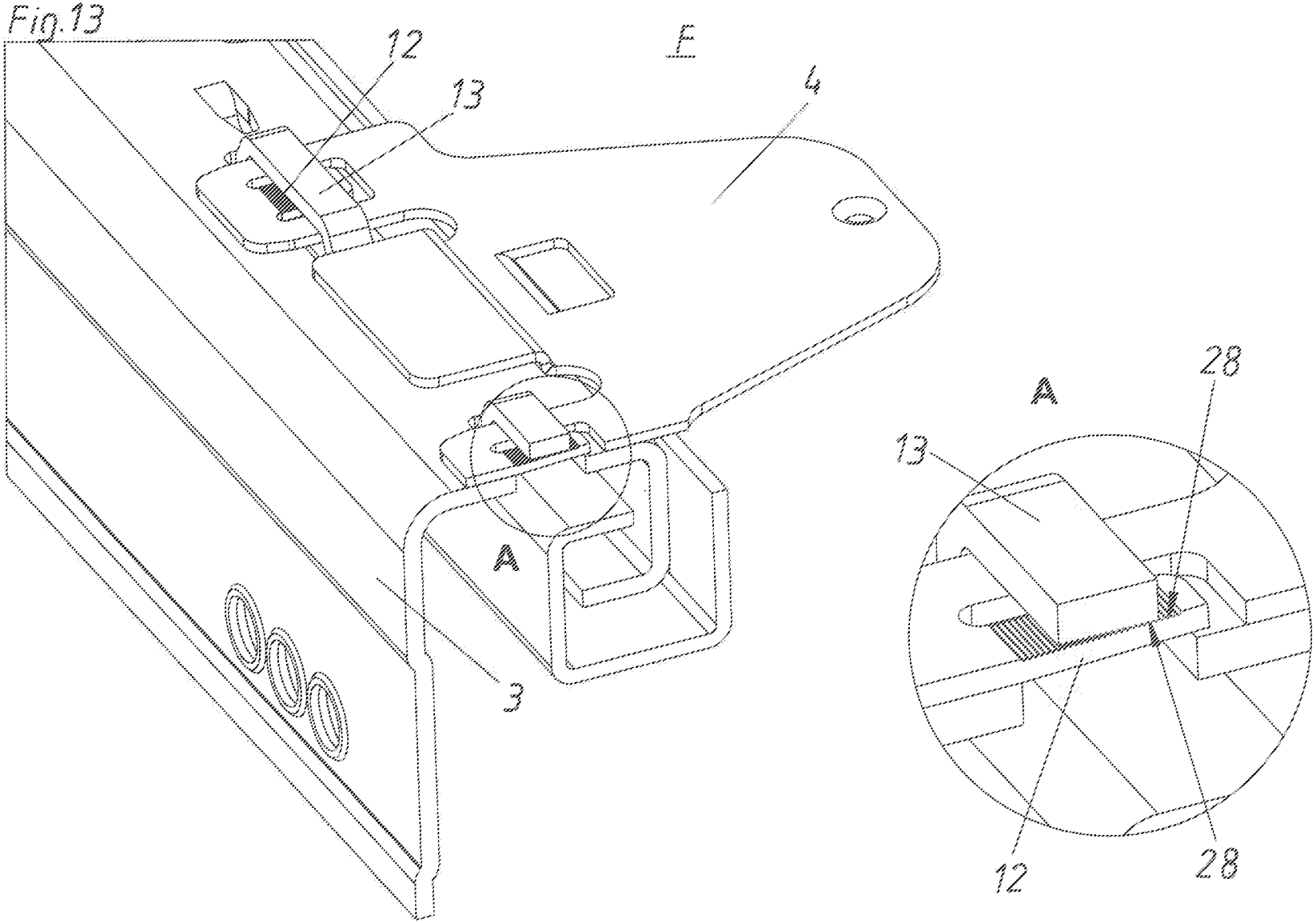

In this embodiment, connecting counterparts 13 in the form of U-shaped lugs are formed on the underside U of the rail 3 (in particular, a pair of U-shaped lugs). These connecting counterparts 13 form guiding elements for the entrainment member 4. As illustrated in FIG. 11, the U-shaped lugs 13 are formed (oriented) to extend along the longitudinal axis of the rail 3 (i.e., parallel to the opening/closing directions of the movable furniture part 2). Slightly bent connecting parts 12 are formed or punched out on the holding plate 7 of the entrainment member 4. Due to the orientation of the U-shaped lugs 13 as noted above, by insertion or sliding of the entrainment member 4 fully through the U-shaped lugs 13 during the fastening movement B as shown in FIG. 12 (i.e., a portion of the entrainment member 4 protrudes through and out of each of the U-shaped lugs 13), the slightly bent connecting parts 12 arrive between the connecting counterparts 13 and the underside U of the rail 3 (see FIG. 12). As also shown in FIG. 12, a portion of the entrainment member 4 abuts or contacts the rail 3 on both sides of the opening of each U-shaped lug 13. The fastening movement B is therefore substantially carried out in an angle of 90° to the longitudinal direction of the rail 3. Thereby the fixing position F is reached without the necessity of a swiveling. In FIG. 13 and in detail A, it is apparent that a ribbed surface (ribs) 28 is formed on both the bottom side of the connecting counterpart 13 (i.e., on an inner surface facing toward the rail 3) and on the upper side of the connecting part 12 (i.e., on an outer surface to face the inner surface of the U-shaped lug 13). This ribbed surfaces 28 tooth or interlock with each other so that a form-fit connection between the entrainment member 4 and the rail 3 is guaranteed. In principle, it would also be possible that only one single connecting part 12 and one single connecting counterpart 13 is provided. By the double implementation, there is indeed a better support. In this embodiment according to FIGS. 11 to 13, each connecting counterpart 13 is formed in one piece with the rail 3. Here, the connecting counterparts 13 can also be pre-mounted on the rail 3 as separate parts.

Although the invention is described in these illustrations especially in regards to an entrainment member 4 in the form of an ejection entrainment member which is attached to a rail 3 in the form of a carcass rail, the same ideas according to the invention of course also apply for other entrainment members 4 (e.g., for a retraction entrainment member 27) or for the attachment of the entrainment member 4 on another rail 3 than the carcass rail.

With the present invention, thus, a simple way for the retrofitting of an entrainment member 4 on a rail 3 without a complex demounting is established.

The invention claimed is:

1. An extension guide for a movable furniture part, comprising:

a rail which is oriented horizontally in the mounting position, the rail having a connecting counterpart in the form of a U-shaped lug on an underside of the rail; and an entrainment member for a drive device for driving the movable furniture part, the U-shaped lug forming a guiding element for holding the entrainment member to detachably fasten the entrainment member on the rail, the entrainment member to be brought from a release position into a fixing position with the rail by a fastening movement of the entrainment member, wherein the U-shaped lug is arranged so as to extend along the longitudinal axis of the rail and parallel to opening and closing directions of the movable furniture part such that the fastening movement is carried out in a horizontal plane in a direction perpendicular to the longitudinal axis of the rail and to the opening and closing directions of the movable furniture part.

2. The extension guide according to claim 1, wherein the entrainment member comprises a holding plate having a bent connecting part formed thereon.

3. The extension guide according to claim 2, wherein the entrainment member and the rail are configured such that, during the fastening movement of the entrainment member, the bent connecting part is inserted between U-shaped lug and the underside of the rail.

4. An extension guide for a movable furniture part, comprising:

a rail which is oriented horizontally in the mounting position, the rail having a connecting counterpart in the form of a U-shaped lug on an underside of the rail; and an entrainment member for a drive device for driving the movable furniture part, the U-shaped lug forming a guiding element for holding the entrainment member to detachably fasten the entrainment member on the rail, the entrainment member to be brought from a release position into a fixing position with the rail by a fastening movement of the entrainment member such that the entrainment member fully extends through the U-shaped lug so that a portion of the entrainment member protrudes out of the U-shaped lug and the entrainment member contacts the rail on both sides of the U-shaped lug, the fastening movement being carried out in a horizontal plane.

5. The extension guide according to claim 4, wherein the entrainment member comprises a holding plate having a bent connecting part formed thereon.

6. The extension guide according to claim 5, wherein the entrainment member and the rail are configured such that, during the fastening movement of the entrainment member, the bent connecting part is inserted between U-shaped lug and the underside of the rail.

7. An extension guide for a movable furniture part, comprising:

a rail which is oriented horizontally in the mounting position, the rail having a connecting counterpart in the form of a U-shaped lug on an underside of the rail, the U-shaped lug having ribs on an inner surface thereof facing toward the rail; and an entrainment member for a drive device for driving the movable furniture part, the entrainment member having ribs on at least a portion of an outer surface thereof to face the inner surface of the U-shaped lug, the U-shaped lug forming a guiding element for holding the entrainment member to detachably fasten the entrainment member on the rail such that the ribs on the inner surface of the U-shaped lug engage and interlock with the ribs on the outer surface of the entrainment member, the entrainment member to be brought from a release position into a fixing position with the rail by a fastening movement of the entrainment member, the fastening movement being carried out in a horizontal plane.

8. The extension guide according to claim 7, wherein the entrainment member comprises a holding plate having a bent connecting part formed thereon.

9. The extension guide according to claim 8, wherein the entrainment member and the rail are configured such that, during the fastening movement of the entrainment member, the bent connecting part is inserted between U-shaped lug and the underside of the rail.

10. An extension guide for a movable furniture part, comprising:

a rail which is oriented horizontally in the mounting position, the rail having a pair of connecting counterparts in the form of U-shaped lugs on an underside of the rail, the U-shaped lugs being arranged along a straight line on the underside of the rail; and an entrainment member for a drive device for driving the movable furniture part, the U-shaped lug forming a guiding element for holding the entrainment member to detachably fasten the entrainment member on the rail, the entrainment member to be brought from a release position into a fixing position with the rail by a fastening movement of the entrainment member, the fastening movement being carried out in a horizontal plane.

11. The extension guide according to claim 10, wherein the entrainment member comprises a holding plate having a bent connecting part formed thereon.

12. The extension guide according to claim 11, wherein the entrainment member and the rail are configured such that, during the fastening movement of the entrainment member, the bent connecting part is inserted between U-shaped lug and the underside of the rail.

* * * * *